US006544201B1

(12) United States Patent
Guitay

(10) Patent No.: US 6,544,201 B1
(45) Date of Patent: Apr. 8, 2003

(54) MASSAGE APPARATUS OPERATING BY SUCTION AND MOBILIZATION OF THE SKIN TISSUE

(75) Inventor: Louis-Paul Guitay, Monteleger (FR)

(73) Assignee: LPG Systems, Valence (FR); part interest ( * ) Notice: Subject to any disclaimer, the term of this patent is extended or adjusted under 35 U.S.C. 154(b) by 0 days.

(21) Appl. No.: 09/508,484

(22) PCT Filed: Aug. 3, 1998

(86) PCT No.: PCT/FR98/01725

§ 371 (c)(1),
(2), (4) Date: Mar. 10, 2000

(87) PCT Pub. No.: WO99/12515

PCT Pub. Date: Mar. 18, 1999

(30) Foreign Application Priority Data

Sep. 11, 1997 (FR) ..... 97 11522

(51) Int. Cl.[7] ..... A61H 7/00

(52) U.S. Cl. ..... 601/6; 601/122; 15/344; 15/384

(58) Field of Search ..... 601/6–10, 122, 601/123, 126, 133, 118; 15/344, 345, 384, 389, 391, 394

(56) References Cited

U.S. PATENT DOCUMENTS

| | | | | | |
|---|---|---|---|---|---|
| 1,891,503 | A | * | 12/1932 | Smellie | |
| 2,574,601 | A | | 11/1951 | Swanson | |
| 3,297,024 | A | * | 1/1967 | Robinson | 128/38 |
| 3,850,163 | A | | 11/1974 | Andis, Sr. | |
| 4,729,368 | A | | 3/1988 | Guitay | |
| 4,883,047 | A | * | 11/1989 | Guitay | 128/38 |
| 5,077,863 | A | * | 1/1992 | Rench | 15/384 |
| 5,665,053 | A | * | 9/1997 | Jacobs | 601/2 |
| 5,885,232 | A | | 3/1999 | Guitay | |
| 6,017,320 | A | * | 1/2000 | Bleeker et al. | 601/125 |

FOREIGN PATENT DOCUMENTS

| | | | |
|---|---|---|---|
| EP | 0224422 | 11/1986 | A61H/15/00 |
| EP | 0284 527 B1 | 3/1988 | A61H/15/00 |
| EP | 0 284 527 | 3/1988 | A61H/15/00 |
| FR | 409202 | 7/1909 | |
| FR | 168279 | 9/1934 | |
| FR | 1590131 | 7/1968 | |
| FR | 2057514 | 8/1969 | A71H/7/00 |
| FR | 2 723 310 | 8/1994 | A61H/9/00 |
| FR | 2 744 358 | 2/1996 | A61H/15/00 |
| WO | WO 91/14417 | 3/1991 | A61H/15/00 |

* cited by examiner

*Primary Examiner*—Justine R. Yu
(74) *Attorney, Agent, or Firm*—Heslin Rothenberg Farley & Mesiti P.C.; Victor A. Cardona, Esq.

(57) ABSTRACT

The invention concerns a massage apparatus operating by suction and mobilization of the skin tissue, in the form of a manually operated set (1), essentially comprising a housing connected to a suction source and including an inner chamber (4) open on its surface designed to be in contact with the patient's body and means for exerting a mechanical action on the skin fold formed inside said chamber (4) during the massage. The invention is characterized in that the suction chamber extends transversely over the whole width of the housing and is open at its two lateral ends; the means for exerting a mechanical action consist of at least two mobile sets (7, 8) laterally arranged on each housing (3) side, resting sealed against the side walls and obstructing the lateral openings of the suction chamber.

9 Claims, 2 Drawing Sheets

MASSAGE APPARATUS OPERATING BY SUCTION AND MOBILIZATION OF THE SKIN TISSUE

The present invention relates to an improved massage appliance making it possible simply and effectively to carry out massages in which a suction and mobilization action is exerted on the skin tissue of the patient which may be both a human being and an animal (horses, cattle, etc.).

It has been proposed for decades to produce appliances of this type, as may be gathered, in particular, from FR-A-409 202, Swiss Patent 168 279, U.S. Pat. Nos. 3,297,024 and 2,574,601 and also FR-A-1 590 131 and 2 057 514, and to produce such appliances in order to make the masseur's work easier. In general terms, these appliances may be said to make it possible to exert an action of pressure, displacement, vibratory friction, suction, etc. on the body.

More recently, in the European Patents 224 422, and 284 527 and in FR-A-2 723 310, the inventor of the present application proposed improved massage appliances which make it possible to carry out massages of the "palpated/rolled" type simply and effectively.

In general terms, the appliances described in these latter documents consist essentially of two rollers mounted on a housing along parallel axes, and being capable of being mounted either with a fixed centre distance or a variable centre distance and being driven positively in rotation, the said housing being connected to means comprising a conduit, the end of which opens into the space contained between the rollers, thus making it possible to generate a vacuum which tends to suck the skin in such a way that it forms a fold on which the rollers exert a pinching action.

Such appliances are fully satisfactory from a practical point of view, but require some skill on the part of the operator, particularly when rapid changes in the direction of the massage action are to be made.

Moreover, in this type of appliance, friction against the side walls occurs, thus giving rise to a relatively vigorous action on the part of the operator causing the latter to become fatigued. Furthermore, this friction sometimes gives the patient an unpleasant feeling.

A new type of massage appliance has been found, then, this being the subject of the present invention, which, like all the appliances of the type mentioned above, makes it possible to exert a suction and mobilization action on skin tissue with a high degree of efficiency and which, moreover, is much easier to handle, easy to use and pleasant for the patient. Furthermore, such an appliance also affords the possibility of instantaneous action at 360°, and also virtually no friction on the skin, thus making the massage sensation much more pleasant.

In addition, since the appliance according to the invention gives rise to limited friction, this makes it possible to produce large-size non-motorized massage assemblies.

In general terms, the new massage appliance according to the invention, making it possible to exert a suction and mobilization action on the skin tissue of the patient, takes the form of a manually actuable assembly comprising essentially a housing which is connected to a suction source and which comprises an inner chamber open on its face intended to be in contact with the patient's body, and of means making it possible to exert a mechanical action on the skin fold formed inside the chamber during the massage operation, and it is characterized in that:

- the suction chamber extends transversely over the entire width of the housing and is open at its two lateral ends;
- the means making it possible to exert the mechanical action consist of at least two movable assemblies which are arranged laterally on each side of the housing, bear sealingly against the side walls and shut off the lateral orifices of the suction chamber.

In a preferred embodiment according to the invention, the housing consists of a one-piece assembly comprising an inner chamber which is connected to a suction source and which forms a transverse slot open at its ends and intended to come to bear against the patient's body, the active elements being mounted on the side walls of the housing, at the same time shutting off the lateral orifices of the chamber.

According to this embodiment, the active elements consist, for example, of two discs mounted freely rotatably about a shaft carried by the housing.

Moreover, in this embodiment, the suction generated inside the chamber is obtained by means of a plurality of conduits which open out in the upper wall of the said chamber.

If the lower edges of the slot can be rectilinear, it is conceivable to have a configuration of the inner chamber such that the lower edges forming the slot are concave or convex or the like. Furthermore, it is also conceivable to mount, inside the chamber, active transverse rollers acting in a similar way to the teachings of the abovementioned patents in the inventor's name.

Finally, the appliance according to the invention will be connected to the outlet of a suitable suction circuit. Preferably, this suction circuit will comprise a solenoid valve produced according to the teachings of the Patent Application WO 95/09596, which makes it possible to obtain not only all-or-nothing operation, but also a controlled flow of the air fluid between two predetermined values, with the possibility of adjustment between the said values, thus making it possible to obtain "sequential, pulsatory, rhythmic" operation, such as during the massage operation, the suction rate varying cyclically.

However, the invention and the advantages which it affords will be understood more clearly from the exemplary embodiment given below by way of non-limiting indication and illustrated in the accompanying diagrams in which.

Figure 1:
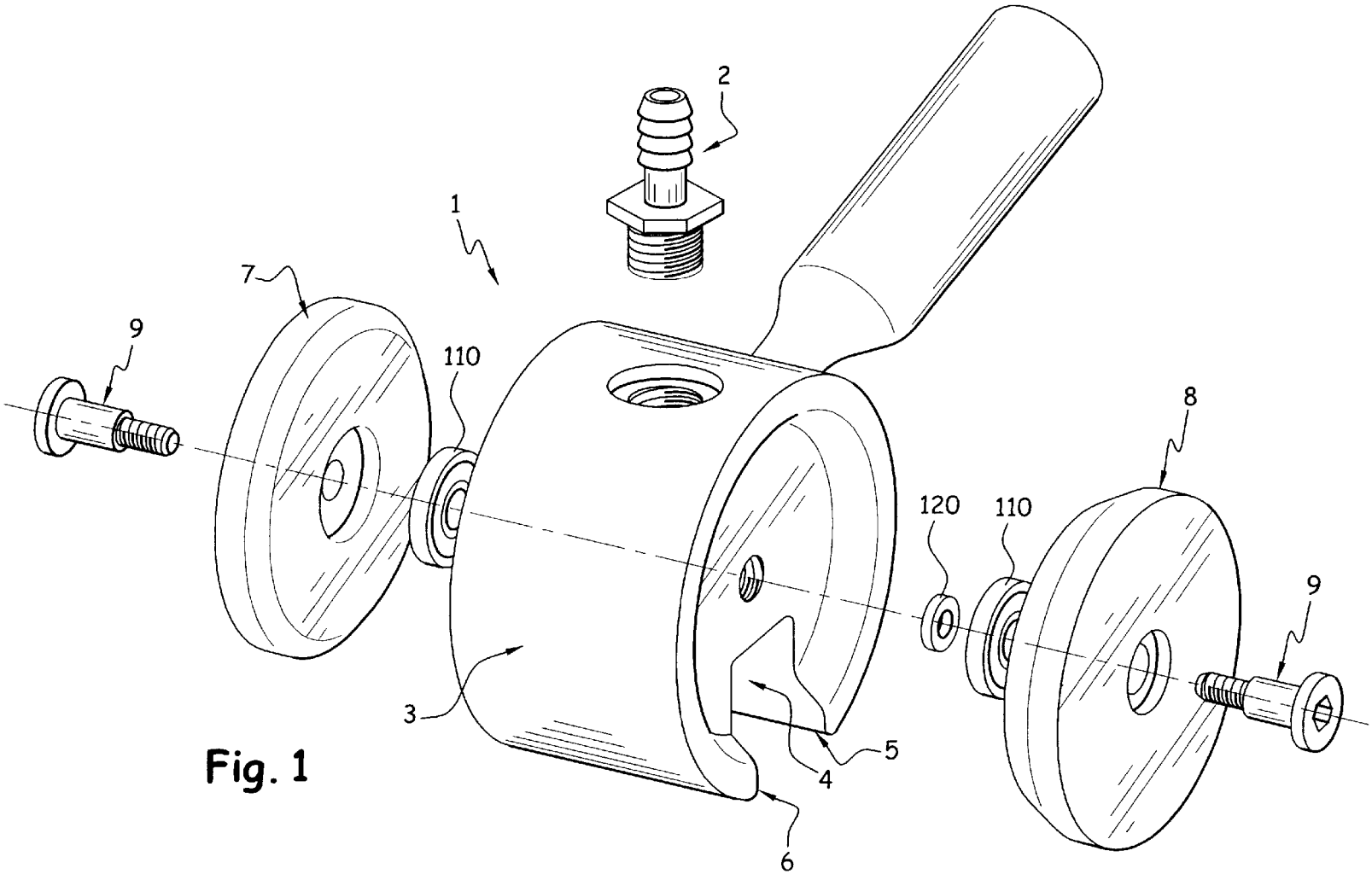
FIG. 1 is a diagrammatic perspective view of a massage appliance produced according to the invention, the means making it possible to carry out the suction action not being illustrated.

Referring to the accompanying diagrams, the massage appliance according to the invention, making it possible to exert a suction and mobilization action on the skin tissue of the patient, therefore takes the form of a manually actuable assembly, designated by the general reference (1), which is connected to a suction source, not illustrated, permanently or removably by means of a conduit (2). This assembly (1) takes the form of a housing (3) which comprises an inner chamber (4) open on its face and intended to be in contact with the patient's body, the chamber being associated with means making it possible to exert a mechanical action of the skin fold formed inside the chamber during the massage operation.

According to the invention, the suction chamber (4) extends transversely over the entire width of the housing and is open at its two lateral ends. The dimensions of this chamber will be adapted according to the type of massage to be carried out, for example treatment over a large area or, instead, on a highly localized zone, treatment of patients of differing morphology, for example children, adults, animals, etc.

In general, a range of appliances, of which the width of the housing is between 1 cm and 10 cm and the opening of the slot between 1 cm and 6 cm, makes it possible, in practice, to treat any type of patient and any zone on the body.

Figure 4:
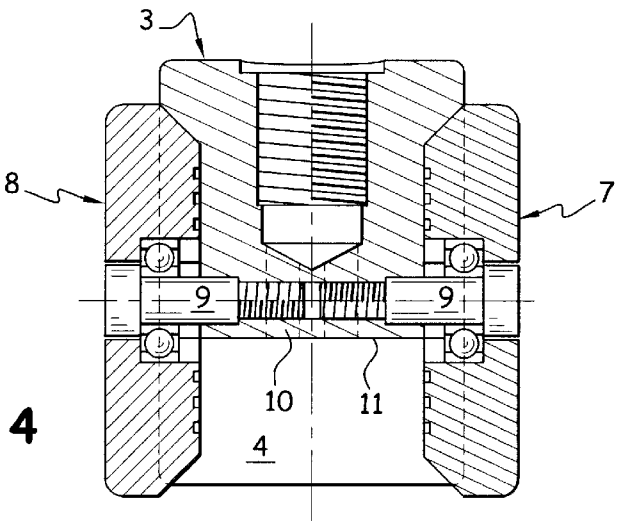
FIG. 4 is a sectional view along the axis BB of FIG. 2, the lateral active elements likewise being illustrated.
Figure 3:
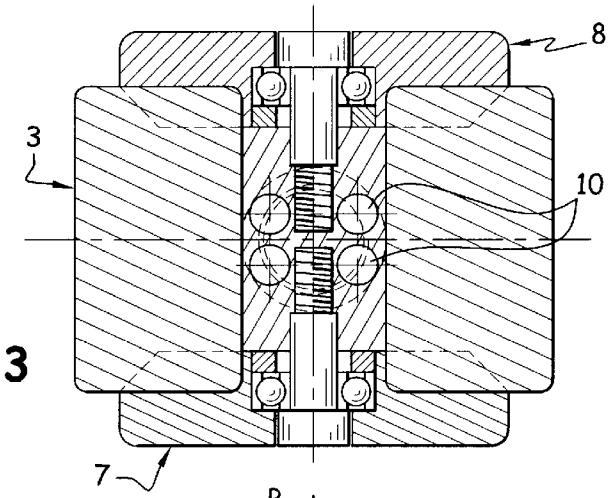
FIG. 3 is a bottom view of FIG. 2, which comprises a partial section through its central part along AA of the figure and which illustrates the lateral active elements.
Figure 2:
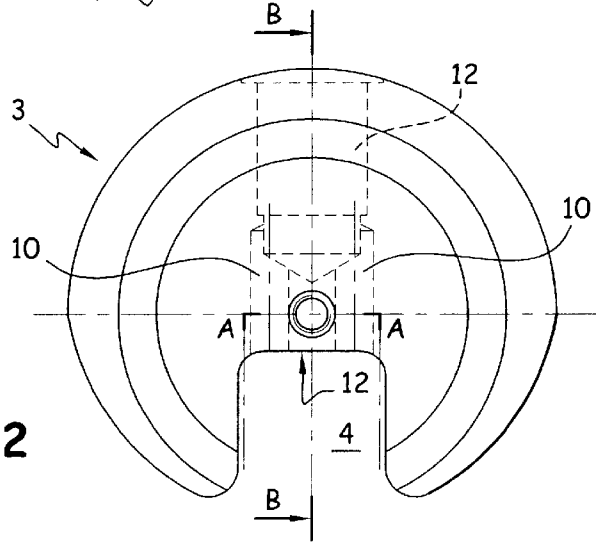
FIG. 2 is a side view of the housing which comprises an appliance according to the invention.

As an indication, FIGS. 2, 3 and 4 illustrate a massage head according to the invention substantially to the scale 1 of average size.

The lower edges (5, 6) of the chamber will preferably be rounded so as to make it easier for the skin fold to be formed.

According to the invention, the means making it possible to exert the mechanical action consist of active elements, specifically, two movable assemblies (7,8), which are arranged laterally on each side of the housing (3), bear sealingly against the side walls and shut off the lateral orifices of the suction chamber (4). The housing (3) advantageously takes the form of a one-piece assembly, the movable assemblies (7,8) advantageously consisting of two discs mounted freely rotatably about shafts (9) carried by the housing (3), the assembly operation being carried out conventionally by means of suitable rolling bearings and plain bearings. A bearing 110 and a spacer 120 may be located on shaft 9 between movable assemblies 7, 8 and housing 3.

The diameter of the discs will generally be between 1 cm and 12 cm, thus making it possible to produce a full range of appliances allowing any type of patient and any zone on the body to be treated. The upper limit of 12 cm given above is not limiting, however, and it is conceivable for the discs to have a larger diameter.

Suction within the chamber so as to form the skin fold takes place via one or more conduits (10) which open out in the upper wall (11) of the chamber (4).

In the exemplary embodiment given, there are four of these conduits, and they are oriented orthogonally to the wall (11) of the chamber and open into a common conduit (12) connected to a suction source.

Such an appliance design thus makes it possible to obtain an action on the skin fold, such as during the massage operation, and, under the twin action of the suction and the speed of advance against the patient's body, a fold is formed which is rolled up and unrolled and on the lateral faces of which the discs (7, 8) come to bear, the discs being driven in rotation and therefore accompanying the displacement of the fold, at the same time eliminating virtually any friction phenomenon on the surface of the skin. Specifically, the device is operated by a user placing it against the skin of a patient when the suction is actuated through a plurality of conduits which open out in the upper wall of the chamber. Thus, the user may move the device along the skin of the patient to provide a massaging effect.

As compared with the prior solutions, such an appliance not only makes it possible to obtain a massage of the "palpated/rolled" type, but has easier handling due to the presence of the lateral and independent movable bearing zones. It was found that the displacement of the appliance against the patient's body was made easier and that the massage sensation was more pleasant, and painless, friction on the skin being reduced.

Furthermore, it is appropriate to note that such a structure also allows the possibility of instantaneous action at 360°.

The invention is, of course, not limited to the exemplary embodiment described above, but embraces all the variants produced in the same spirit, the housing structure, simply indicated diagrammatically in the example illustrated, having an outer shape which, of course, is designed to make it easier for the operator to grasp it.

Moreover, as mentioned above, it is possible to adapt to the interior of the chamber transverse rollers which are mounted freely rotatably, and, if appropriate, are even motorized, and the spacing of which may be either fixed or variable, and which exert an action complementary to the lateral active elements during the massage operation, friction against the skin then being virtually non-existent.

What is claimed is:

1. A massage appliance for exerting a suction and mobilization action on skin tissue of a patient's body, said massage appliance comprising a housing which is connected to a suction source, said housing comprising an inner chamber having an opening contactable with the patient's body, and having means for exerting a mechanical action on a skin fold formed inside said inner chamber during massage operation, wherein:

said housing comprises a plurality of side walls;

said inner chamber extends transversely over an entire width of said housing, said inner chamber comprises a first lateral end and a second lateral end corresponding to a first side wall and a second side wall of said plurality of side walls of said housing, respectively, and said inner chamber comprises a first lateral opening and second lateral opening at said first lateral end and said second lateral end, respectively;

said means for exerting a mechanical action comprises a first movable assembly mounted laterally on said first side wall of said plurality of side walls of said housing, bearing sealingly against said first side wall of said plurality of side walls of said housing and shutting off said first lateral opening of said inner chamber; and said means for exerting a mechanical action further comprises a second moveable assembly mounted laterally on said second side wall of said plurality of side walls of said housing, bearing sealingly against said second side wall and shutting off said second lateral opening of said inner chamber.

2. A massage appliance according to claim 1, wherein said housing comprises a one-piece assembly, said inner chamber is connected to a suction source and forms a transverse slot having said first lateral opening and said second lateral opening at said first lateral end and said second lateral end, respectively, and said transverse slot is adapted to bear against the patient's body, said first movable assembly is mounted on an exterior surface of said first side wall of the housing for shutting off said first lateral opening of said inner chamber, and said second moveable assembly is mounted on an exterior surface of said second side wall of said housing for shutting off said second lateral opening of said inner chamber.

3. A massage appliance according to claim 2, wherein said first moveable assembly comprises a disc mounted freely rotatable about a shaft carried by said housing, whereby virtually any lateral friction on the skin fold is eliminated, and said second moveable assembly comprises a second disc mounted freely rotatable about said shaft carried by said housing, whereby virtually any lateral friction on the skin fold is eliminated.

4. A massage appliance according to claim 3, wherein said inner chamber comprises an upper wall, and said appliance further comprises at least one conduit for conducting suction from said suction source to said inner chamber through said upper wall.

5. The massage appliance of claim 4 wherein said at least one conduit is coupled to said suction source and said conduit passes through said upper wall.

6. The massage appliance of claim 4 wherein said conduit comprises a plurality of said at least one conduit.

7. The massage appliance of claim 5 wherein said conduit comprises a plurality of conduits.

8. A system for providing a suction and mobilization action on skin tissue of a patient's body, said system comprising:

a housing connected to a suction source wherein said housing comprises an inner chamber having an opening adapted for contact with the patient's body;

means for providing a mechanical action on a skin fold formed inside said inner chamber during a massage operation;

wherein said inner chamber comprises a second opening, wherein said means for providing a mechanical action comprises a moveable assembly, and wherein said moveable assembly is moveably mounted to said housing and said moveable assembly bears sealingly against said housing to cover said second opening, said moveable assembly being moveable relative to said housing during said massage operation, and said movable assembly has a peripheral for contacting skin tissue.

9. The system of claim 8 wherein said moveable assembly bears sealingly against an exterior surface of said housing to cover said second opening.

* * * * *